US006489578B1

(12) United States Patent
Jung et al.

(10) Patent No.: US 6,489,578 B1
(45) Date of Patent: Dec. 3, 2002

(54) ELECTRICAL SWITCH

(75) Inventors: Peter Jung, Baligen (DE); Gerhard Niklewski, Trossingen (DE); Klaus Merkel, Spaichingen (DE)

(73) Assignee: Marquardt GmbH, Rietheim - Weilheim (DE)

( * ) Notice: Subject to any disclaimer, the term of this patent is extended or adjusted under 35 U.S.C. 154(b) by 0 days.

(21) Appl. No.: 09/646,008

(22) PCT Filed: Mar. 10, 1999

(86) PCT No.: PCT/DE99/00636

§ 371 (c)(1),
(2), (4) Date: Jul. 11, 2001

(87) PCT Pub. No.: WO99/46787

PCT Pub. Date: Sep. 16, 1999

(30) Foreign Application Priority Data

Mar. 11, 1998 (DE) ..... 198 10 332
Dec. 1, 1998 (DE) ..... 198 55 263

(51) Int. Cl.[7] ..... H01H 9/06
(52) U.S. Cl. ..... 200/332.2; 200/1 V
(58) Field of Search ..... 200/1 V, 17 R, 200/18, 61.85, 522, 567, 318, 318.1, 321, 322, 327, 329, 332.1, 332.2, 334

(56) References Cited

U.S. PATENT DOCUMENTS 3,467,801 A * 9/1969 Matthews ..... 200/1 V
3,814,886 A 6/1974 Piber ..... 200/157
4,097,703 A 6/1978 Houser ..... 200/157
4,097,704 A * 6/1978 Piber ..... 200/1 V
4,348,603 A * 9/1982 Huber ..... 310/50
4,698,471 A * 10/1987 Piber ..... 200/302.2
4,864,083 A * 9/1989 Bittel ..... 200/1 V
5,198,793 A * 3/1993 Leveque ..... 200/522

FOREIGN PATENT DOCUMENTS

EP 0 057 414 A2 11/1982 ..... H01H/9/06

* cited by examiner

*Primary Examiner*—Michael Friedhofer
(74) *Attorney, Agent, or Firm*—Morgan, Lewis & Bockius LLP

(57) ABSTRACT

An electrical switch (4), in particular for electric hand tools (1), such as electric drills, hammer drills, electric screwdrivers or the like, has an actuating member (5) that can be moved from an initial position into an operating position. In the operating position, the actuation member (5) acts, for example, to switch a contact system or to adjust a potentiometer. In addition, the switch (4) has a movable actuating element (13) which, when it is moved, acts to actuate a first device the actuating element (13) is arranged in the immediate vicinity of the actuating member (5). Furthermore, in addition, a further, second device can be actuated by means of the actuating element (13).

18 Claims, 13 Drawing Sheets

ELECTRICAL SWITCH

BACKGROUND OF THE INVENTION

The invention relates to an electrical switch for use in electric hand tools, such as electric drills, hammer drills, electric screwdrivers or the like, to switch the electric motor on and off and, if appropriate, to control the rotational speed of the electric motor.

DE-A 24 10 871 discloses an electrical switch with a housing in which a contact system is arranged. Mounted such that it can be moved on the housing is an actuating member which serves as a manual handle and which can be moved by the user into an actuating or operating position. In the operating position, the actuating member then acts to switch the contact system. In order to lock the actuating member in the operating position, the switch also has a locking device. The locking device comprises a slide that is connected to the actuating member and is guided on a side wall of the housing, and an actuating element that is mounted such that it can be moved on the side wall of the housing. By means of manual movement of the actuating element essentially perpendicularly with respect to the side wall of the housing, in the operating position of the actuating member, the actuating element can be brought to interact with the actuating member in order to lock the actuating member.

The actuating element for the known locking device is located on the side wall of the housing of the switch. In many cases, when the electric hand tool is used, manual handling of the actuating element can become arduous.

A switch for an electric tool, having a lateral locking device actuated by a plunger is also disclosed by U.S. Pat. No. 3,814,886. In addition, the switch has a changeover switch for reversing the direction of rotation of the electric tool. A rotary knob for actuating the changeover switch is arranged concentrically with a sleeve to accommodate the plunger. The rotation of the rotary knob about the sleeve moves a contact slide, which is connected to the rotary knob by means of a joint, as a result of which the changeover switch is actuated in order to reverse the polarity of the electric motor. The plunger for the locking device and the rotary knob for the changeover switch for reversing the direction of rotation are two separate actuating elements which differ from each other. Because of the lateral arrangement of the two actuating elements, again their manual operability can be made more difficult.

Furthermore, U.S. Pat. No. 4,097,703 discloses an electrical switch for electrical appliances in which an actuating member can be moved from an initial position into an operating position, so that, in the operating position, the actuating member acts to switch a contact system and to adjust a potentiometer. The switch has a movable actuating element which, during its movement, acts to actuate a first locking device on the switch. For electrical appliances with an electric motor which can be operated reversibly and which can be operated in two opposite directions of rotation, this switch has an additional switching element for changing over the direction of rotation. This additional switching element is actuated by a slide which is located on the rear of the switch, which is opposite the actuating member and the actuating element. Here, too, the actuation of actuating member, actuating element and slide is made more difficult for the user during the use of the electrical appliance. In particular, there is a risk of maloperation.

As a rule, so-called universal motors are used in electrical appliances. In these universal motors, the carbon brushes which feed the power to the armature via the collector are adjusted from the neutral position by a certain angle in order to achieve optimization of the motor operation in one direction of rotation. In order to achieve optimization in the other direction of rotation of the electric motor as well, a device for adjusting the carbon brushes can also be arranged on the electric motor.

DE 195 45 651 A1 discloses a device for adjusting the carbon brushes for the electric motor in accordance with its direction of rotation. This device for adjusting the carbon brushes has a pivotable carrier, on which brush holders for the carbon brushes which slip on the collector of the electric motor are arranged. The carrier can be pivoted manually by means of an actuating element. The electrical changeover switch for the direction of rotation of the electric motor can be integrated into this device for adjusting the carbon brushes at the same time.

In order to start up the electrical appliance, the user has to set the direction of rotation by means of the actuating element located on the device for adjusting the carbon brushes. In addition, in order to operate the electrical appliance, the actuating member of the electrical switch has to be actuated manually by the user. Both the electrical switch and the device for adjusting the carbon brushes are arranged at different points relatively far removed from each other on the electrical appliance, which means that when the electrical appliance is being used, manual handling of the actuating element can be made more difficult.

Finally, EP-A2-0 057 414 discloses an electric hand tool having a switch which has a trigger, a changeover switch for the direction of rotation of the electric hand tool additionally being arranged on the switch. The changeover switch can be actuated by means of a sliding handle, which is fixed to a lever which is arranged on the upper side of the trigger and can be pivoted about an axis. In addition, a brush carrier with brush holders for the electric motor is arranged in the housing of the electric hand tool such that it can be adjusted. When the lever for actuating the changeover switch is pivoted, at the same time the brush carrier is adjusted. To this end, there is a fork element on the lever, which interacts with a stub axle on the brush holder of the brush carrier.

In this known electric hand tool, two devices are actuated simultaneously by means of the lever as an actuating element, namely on the one hand the adjusting device for the brush carrier and on the other hand the changeover switch for the direction of rotation of the electric motor. However, the lever does not permit mutually independent actuation of the two devices, so that the manual handling of the actuating element is severely restricted.

Starting from EP-A2-0 057 414, the invention is based on the object of developing the electrical switch for an electrical appliance further in such a way that the operation becomes more simple and more convenient for the user.

In a generic electrical appliance, this object is achieved by an electrical switch and a movable actuating element. The electrical switch has an actuating member that can be moved between an initial position and an operating position in a direction of movement. The actuating member, in the operating position, acts to switch a contact system or to adjust a potentiometer. The movable actuating element is arranged in an immediate vicinity of the actuating member. The actuating element, during movement, acts to actuate a first device and a second device. The actuating element includes a first part being mounted such that it can be moved in a second direction and a second part that can be moved both with the first part in the second direction and also in a first direction that is different from the second direction such that the first device is actuated when the actuating element is moved in the first direction, and the second device is actuated when the actuating element is moved in the second direction.

One of these two directions may lie within an angular range of less than +/−90 degrees in relation to the direction of movement of the actuating member. The angle in relation to the direction of movement of the actuating member is preferably up to a maximum of +/−15 degrees. In particular, the actuating element can be moved approximately in the direction of the actuating member.

For the purpose of particularly good handling, the actuating element adjusting the carbon brushes. In addition, in order to operate the electrical appliance, the actuating member of the electrical switch has to be actuated manually by the user. Both the electrical switch and the device for adjusting the carbon brushes are arranged at different points relatively far removed from each other on the electrical appliance, which means that when the electrical appliance is being used, manual handling of the actuating element can be made more difficult.

SUMMARY OF THE INVENTION

The invention is based on the object of developing the electrical switch further in such a way that the operation becomes more simple and more convenient for the user.

In a generic electrical switch, this object is achieved by the characterizing features of claim 1.

The electrical switch according to the invention has a movable actuating element which is arranged in the immediate vicinity of the actuating member. When the actuating element is moved, this acts to actuate a first device on the switch. In addition, by means of the actuating element, a further, second device can be actuated, so that the actuating element represents a type of multifunctional lever. Further refinements of the invention are the subject matter of the subclaims.

In order to actuate the first device, the actuating element can be moved in a first direction and, in order to actuate the second device, can be moved in a second direction, the two directions being different. One of these two directions may lie within an angular range of less than +/−90 degrees in relation to the direction of movement of the actuating member. The angle in relation to the direction of movement of the actuating member is preferably up to a maximum of +/−15 degrees. In particular, the actuating element can be moved approximately in the direction of the actuating member.

For the purpose of particularly good handling, the actuating element can be arranged directly on the upper side of the actuating member, specifically approximately at the transition between the housing body and the handle of the electric tool. In this case, the actuating element is designed as a push button, lever or the like, while the actuating member of the switch is a trigger. The actuating element can then be moved by being pressed essentially in the direction of movement of the trigger.

If one of the two devices is a locking device, then the actuating element for actuating the locking device can be moved in a direction differing from the perpendicular to the direction of movement of the actuating member. It is often the case that the electric tool can be operated both in the clockwise and in the counterclockwise direction. It is then obvious for the electrical switch to include a changeover switch for the clockwise/counterclockwise rotation of the electric tool as one of the two devices. The changeover switch has a changeover lever which is mounted such that it can be pivoted by up to about +/−15 degrees, for example, with respect to the direction of movement of the actuating member. Likewise, it is obvious to design the changeover lever for the clockwise/counterclockwise rotation as an actuating element for the locking device at the same time. The changeover lever can then be moved in its longitudinal direction for the purpose of locking. The changeover lever can be configured in two parts, in such a way that a first part can be pivoted and the other, second part can both be pivoted with the first part and can be moved linearly, counter to a restoring force, approximately radially with respect to the pivoting movement.

In a development, the locking device has a blocking element that can be moved by means of the actuating element. The blocking element is mounted such that it can be moved on the housing of the switch and can be brought by the actuating element into engagement with the movement path of the actuating member in order to lock the actuating member. The blocking element is further provided with a hook which, in order to lock, acts on a blocking face, an undercut or the like on the actuating member. Of course, the hook can also act on a part connected to the actuating member, such as a slide guided laterally on the housing of the switch. Because of the interaction between the hook and the blocking face, the return movement of the actuating member effected by a restoring force in the operating position is prevented, and therefore the actuating member is locked in the operating position.

In one embodiment, the blocking element can be designed as a spring-loaded slide element that is mounted such that it can be moved linearly on a housing part of the switch. In this case, it is obvious to arrange the housing part at the transition between the walls of the housing which are assigned to the changeover switch for the clockwise/counterclockwise rotation and the actuating member. The slide element is guided in the housing part approximately parallel to the wall of the housing facing the actuating member. Furthermore, the slide element has a hook at the first end, which faces away from the wall of the housing that is assigned to the changeover switch for the clockwise/counterclockwise rotation. A wedge face on the actuating element, which is located in particular on the linearly movable, second part of the changeover lever, interacts with the second end of the slide element, which faces the wall of the housing that is assigned to the changeover switch for the clockwise/counterclockwise rotation. As a result, the slide element is displaced by the movement of the actuating element such that, in order to lock, the hook acts on a blocking face on the actuating member, if appropriate a blocking face configured like a shoulder, in the operating position of the actuating member.

In another embodiment, the blocking element is designed as a lever element that is mounted such that it can be rotated on the housing of the switch, for example on the wall of the housing that is assigned to the changeover switch for the clockwise/counterclockwise rotation. From the lever element there projects approximately perpendicularly an arm which extends approximately parallel to the wall of the housing facing the actuating member, and has a hook. A cam on the actuating element, which is located in particular on the linearly movable, second part of the changeover lever, engages in a slotted guide on the lever element. As a result, during the movement of the actuating element, the lever element is pivoted such that the hook, in order to lock, engages behind a blocking face on the actuating member, which is located on the lateral slide, for example, in the operating position of the actuating member.

Furthermore, one of the two devices may be a device for adjusting the carbon brushes for the electric motor, it being possible for this device to be adjusted by means of the movable actuating element. The device for adjusting the carbon brushes can have a pivotable carrier to accommodate the brush holders, a coupling element being arranged between the actuating element and the carrier. The coupling element can be designed in the manner of a gear mechanism or can comprise a toggle lever, tilting lever, a tilting detent mechanism or the like.

In particular, in this case it is also preferred for the actuating element for the device for adjusting the carbon brushes to be designed in the manner of a multifunctional lever. In addition to actuating the device for adjusting the carbon brushes, using this multifunctional lever, the switch for reversing the direction of rotation can be switched at the same time, and the actuation of a locking device for the actuating member in the operating position can be performed.

The advantages achieved by the invention consist in particular in that there is only one actuating element for a number of functions, for example for the locking, adjustment of the carbon brushes and changing over the direction of rotation. This results, on the one hand, in a considerable saving in costs. On the other hand, at the same time the ergonomics for the user when handling the electrical appliance is increased, and the aforementioned functions of the switch can be operated more conveniently for the user. Otherwise, maloperation by the user is also avoided, and the risks of an accident when using the electrical appliance are reduced. For example, changing over the direction of rotation can be blocked by the actuating element in a simple way if the actuating member of the switch is actuated.

In addition to the actuating member of the switch, the actuating element for the locking device and/or for the direction-of-rotation changeover switch and/or for the device for adjusting the carbon brushes can also be accommodated in the handle of the electrical appliance. At the same time, the handle which accommodates the switch and belongs to the electric tool can advantageously be configured to be symmetrical. In particular, it should be emphasized that, in particular, the locking action is equally suitable for right-handed and left-handed people, which is not the case in previous switches.

In addition, no additional opening is needed in the handle of the electric tool, such as was previously needed for the actuating element of the locking device and/or the adjusting device for the carbon brushes and/or for the direction-of-rotation changeover switch. As a result, not only is a more pleasing appearance of the electrical appliance or of the handle achieved, but also improved protection against the penetration of foreign bodies, such as dust, humidity or the like, into the electrical appliance. This also prevents premature failure of the electrical appliance and/or of the switch and/or of the aforementioned devices on the switch, and their service life is increased.

BRIEF DESCRIPTION OF THE DRAWINGS

Exemplary embodiments of the invention are illustrated in the drawings and will be described in more detail below. In the drawings.

DESCRIPTION OF THE PREFERRED EMBODIMENTS

Figure 1:
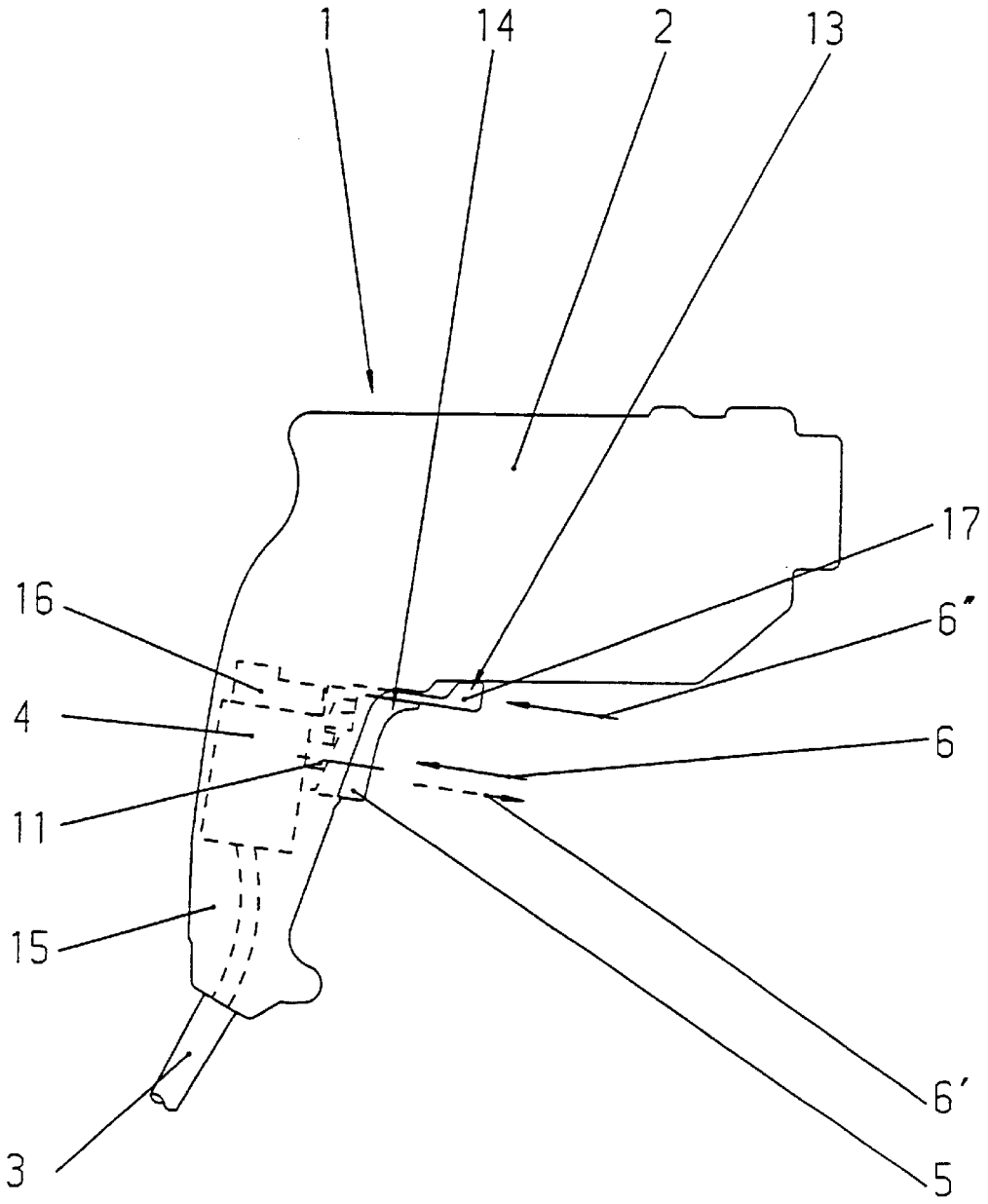
FIG. 1 shows, in schematic form, the housing body of an electric drill corresponding to a first embodiment.

FIG. 1 reveals, in schematic form, a housing body 2 for an electric hand tool 1, specifically in the present case for an electric drill. Located in the housing body 2 is an electric motor 36 which is not shown further here but can be seen, for example, in FIG. 6 and which is supplied with power via a mains feed line 3. In order to switch the electric motor 36 on and off, use is made of an electrical switch 4 which is located in the housing body 2 but is likewise indicated only schematically in FIG. 1. For the purpose of actuation, the switch 4 has an actuating member 5 which is located on the handle 15 of the housing body 2, can be moved in the direction of the arrows 6, 6' and serves as a manual handle for the user. Of course, a switch 4 of this type can also be used in any other electric hand tool, for example in hammer drills, electric screwdrivers, electric circular saws or the like.

Figure 2:
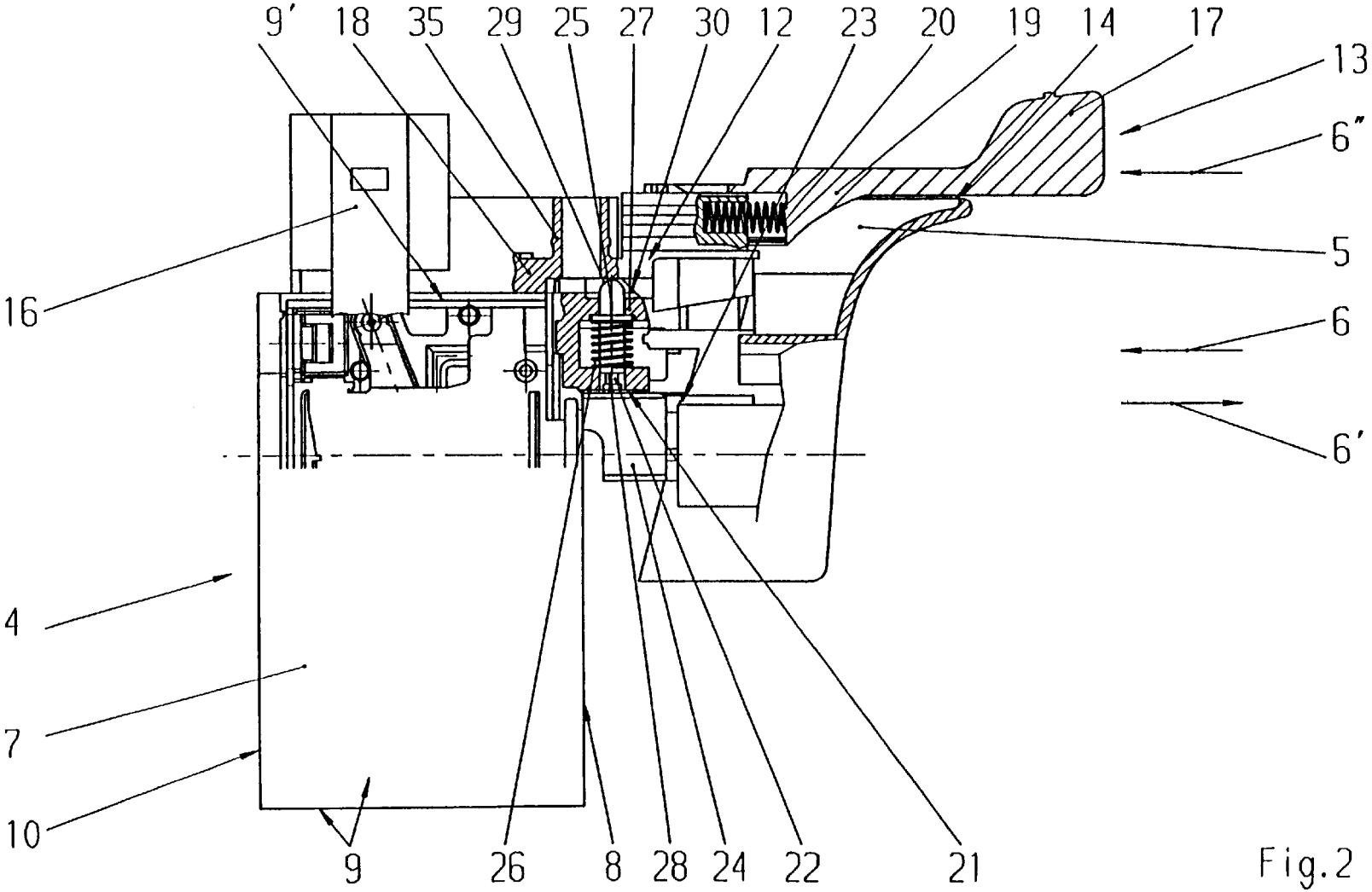
FIG. 2 shows an electrical switch with locking function in side view, the area of the changeover switch being shown in partial section.

As emerges in more detail from FIG. 2, the switch 4 has a housing 7 with a front wall 8, a number of side walls 9, 9' adjoining the front wall 8 and a rear wall 10. The actuating member 5 mounted movably on the housing 7 faces the front wall 8 and is rigidly coupled to a transmission element 11 reaching into the housing 7 (see FIG. 1). Located in the interior of the housing 7 is at least one contact system (not specifically shown) to switch the electric motor 36 of the electric hand tool 1 on and off. Such contact systems are disclosed, for example, by DE-A 28 38 934, so that more detailed discussion of this is not needed. If necessary, a potentiometer, an electronic unit or the like can be arranged in the housing 7 for driving the electric motor 36 at a rotational speed that can be set by the user and/or also for driving other functions of the electric motor 36.

As already explained, the actuating member 5 can be moved by the user in the direction of the arrow 6 from an unactuated initial position. In a specific movement position, which is referred to below as the operating position, the actuating member 5 acts by means of the transmission element 11 to switch the contact system and/or acts on the potentiometer or the like, the electric motor 36 being switched on and/or being driven at a specific rotational speed. If the user releases the actuating member 5, then, because of a restoring force which acts in the direction of the arrow 6', said actuating member 5 is moved back into the unactuated initial position, so that the electric motor 36 is switched off.

The switch 4 further has a locking device 12, which, in order to lock the actuating member 5 in the operating position, can be brought into interaction with the actuating member 5. The locking device 12 then prevents the actuating member 5 being moved back from the operating position in the direction of the arrow 6', so that the electric motor 36 remains switched on when the user releases the actuating member 5. The locking device 12 can be actuated by the user by means of a manually movable actuating element 13.

Differing from electrical switches having a conventional locking device which is located on a side wall of the housing and can be actuated approximately perpendicular to the direction of movement of the actuating member, the locking device 12 of the switch 4 according to the invention essentially faces the actuating member 5. As a result, the actuating element 13 of the locking device 12 is arranged in the immediate vicinity of the actuating member 5. In addition, the actuating element 13 of the locking device 12 can be moved in a direction differing from the perpendicular to the direction of movement 6, 6' of the actuating member 5. It is preferable for the actuating element 13 to be capable of being moved approximately in the direction of movement 6, 6' of the actuating member 5. As can be seen well from FIG. 1, by means of this design, the actuating element 13 can be moved with the same hand which also operates the actuating member 5. As a result, operation is simpler and more ergonomic for the user, which reduces the risks of an accident when using the electric drill 1. In addition, the locking device 12 can be handled equally well by right-handed and left-handed people.

Figure 3:
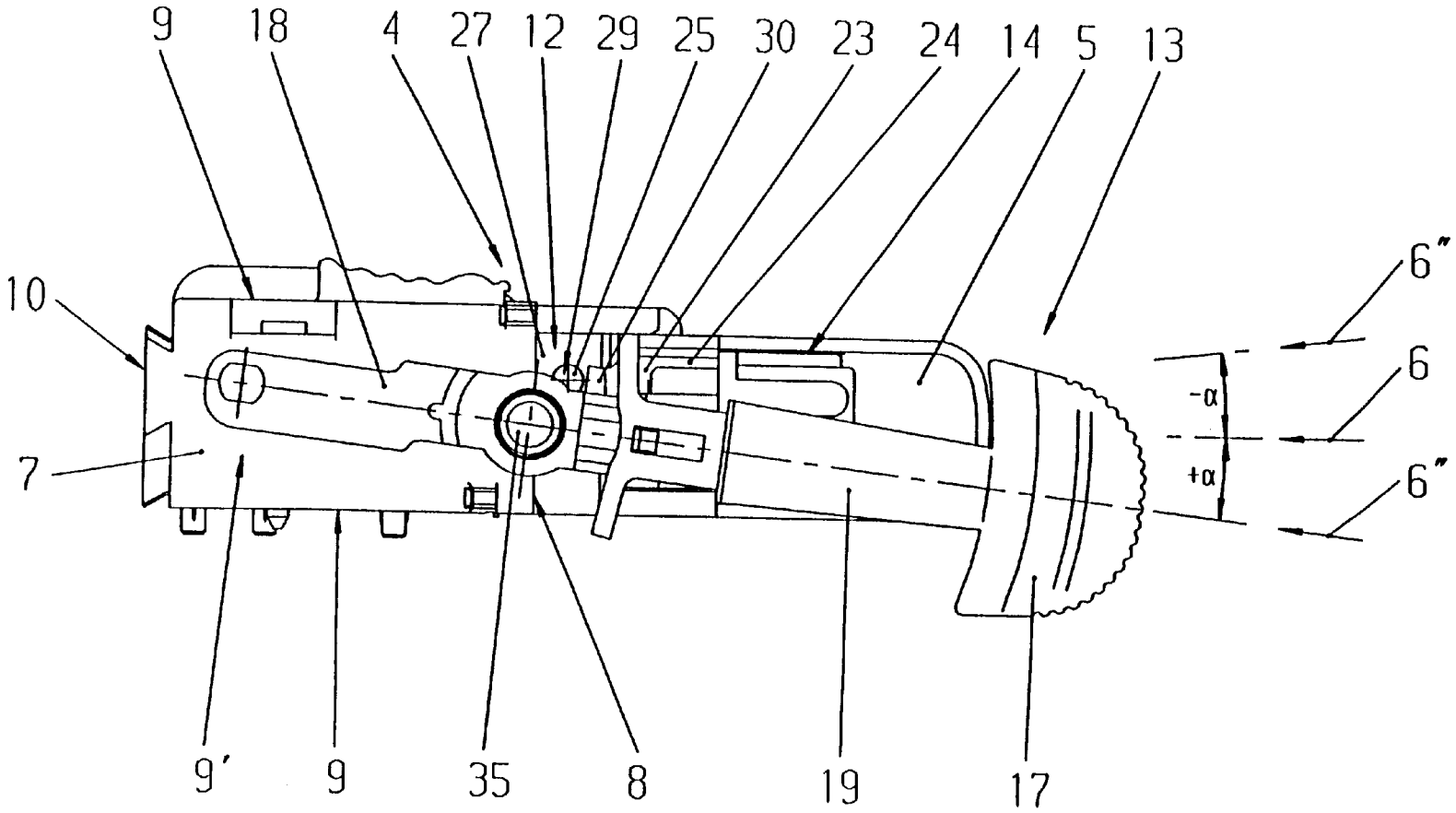
FIG. 3 shows the electrical switch from FIG. 2 in plan view, only the changeover lever being shown, while the rest of the changeover switch has been left out.

In order for the actuating element 13 to be capable of being operated by the user in a simple way, like the actuating member 5, the actuating element 13 can be moved within an angular range of $+/-\alpha$ in relation to the direction of movement 6, 6' of the actuating member 5, as can be seen using FIG. 3. The angle $\alpha$ in relation to the direction of movement 6, 6' of the actuating member 5 is preferably less than +/−90 degrees and is up to a maximum of +/−15 degrees. The actuating member 5 of the switch 4 is expediently designed as a trigger. The actuating element 13 of the locking device 12 can be designed as a push button, as a rotatably mounted lever or the like. In the case of such a design, the actuating element 13 of the locking device 12 can then preferably be moved by being pressed in a direction 6" which extends essentially approximately in the direction of movement 6 of the trigger 5 or parallel to the direction of movement 6. The actuating element 13 of the locking device 12 is arranged directly on the upper side 14 of the actuating member 5. In this case, it is obvious to arrange the actuating element 13 approximately at the transition between the housing body 2 and the handle 15 for the electric drill 1, as emerges in more detail from FIG. 1.

If the electric hand tool is an electric drill 1, then its electric motor 36 can generally be operated reversibly in two opposite directions of rotation, namely both clockwise and counterclockwise. For this purpose, the electrical switch 4 has a changeover switch 16 for clockwise/counterclockwise rotation. As can be seen in FIG. 3, the changeover switch 16 is actuated by means of a changeover lever 17 that is mounted such that it can pivot on a rotary bearing 35. The changeover lever 17 can be pivoted in the counterclockwise direction through an angle $-\alpha$ with respect to the direction of movement 6 in order to switch on counterclockwise rotation, and can be pivoted in the clockwise direction by an angle $+\alpha$ with respect to the direction of movement 6 in order to switch on clockwise rotation. The angle $+/-\alpha$ can be, for example, up to about +/−15 degrees.

In such an embodiment, it is particularly advantageous to design the changeover lever 17 for clockwise/counterclockwise rotation as an actuating element 13 for the locking device 12 at the same time. To this end, the changeover lever 17, in addition to its capability of being pivoted to change over between clockwise and counterclockwise rotation, is designed to be moved in its longitudinal direction in order to actuate the locking device 12, by the changeover lever 17 preferably being configured in two parts. A first part 18 of the changeover lever 17 can be pivoted, and the other, second part 19 can both be pivoted with the first part 18 and can also be moved linearly approximately radially with respect to the pivoting movement. The linear movement of the second part 19 is carried out counter to the restoring force of a spring 20, as shown in more detail in FIG. 2.

The locking device 12 further has a blocking element 21 which can be moved by means of the actuating element 13. The blocking element 21 is mounted such that it can be moved on the housing 7 of the switch 4. The blocking element 21 can then be brought by the actuating element 13 into engagement with the movement path of the actuating member 5, running in the direction of movement 6, 6', in order to lock the actuating member 5. For this purpose, the blocking element 21 is provided with a hook 22. In order to lock, the hook 22 acts on a blocking face 23, an undercut or the like on the actuating member 5. Of course, the hook 22 can also act on a part connected to the actuating member 5, such as a slide 24 guided laterally on the housing 7 of the switch 4. As a result of the interaction of the hook 22 with the blocking face 23, the return movement of the actuating member 5, which is effected by the restoring force acting on the actuating member 5 in the operating position, is then prevented.

According to a first configuration, which can likewise be seen in more detail in FIGS. 2 and 3, the blocking element 21 is designed as a slide element 25 loaded by a spring 26. The slide element 25 is mounted such that it can be moved linearly on a housing part 27 of the switch 4, the housing part 27 being arranged at the transition between the walls 8, 9' of the housing 7 which are assigned to the changeover switch 16 for the clockwise/counterclockwise rotation and the actuating member 5. The slide element 25 is guided in the housing part 27 approximately parallel to the front wall 8 of the housing 7 facing the actuating member 5. The hook 22 is located at the first end 28 of the slide element 25, the first end 28 facing away from the side wall 9' of the housing 7 which is assigned to the changeover switch 16 for the clockwise/counterclockwise rotation. A wedge face 30 on the actuating element 13, to be specific on the linearly movable, second part 19 of the changeover lever 17, interacts with the second end 29 of the slide element 25, the second end 29 facing the side wall 9' of the housing 7 which is assigned to the changeover switch 16 for the clockwise/counterclockwise rotation. This interaction takes place in such a way that, when the actuating element 13 is moved, the slide element 25 is displaced by means of the wedge face 30 in such a way that the hook 22, in order to lock, acts on the blocking face 23 in the operating position of the actuating member 5. The blocking face 23 has a shoulder-like configuration and is located on the lateral slide 24.

Figure 4:
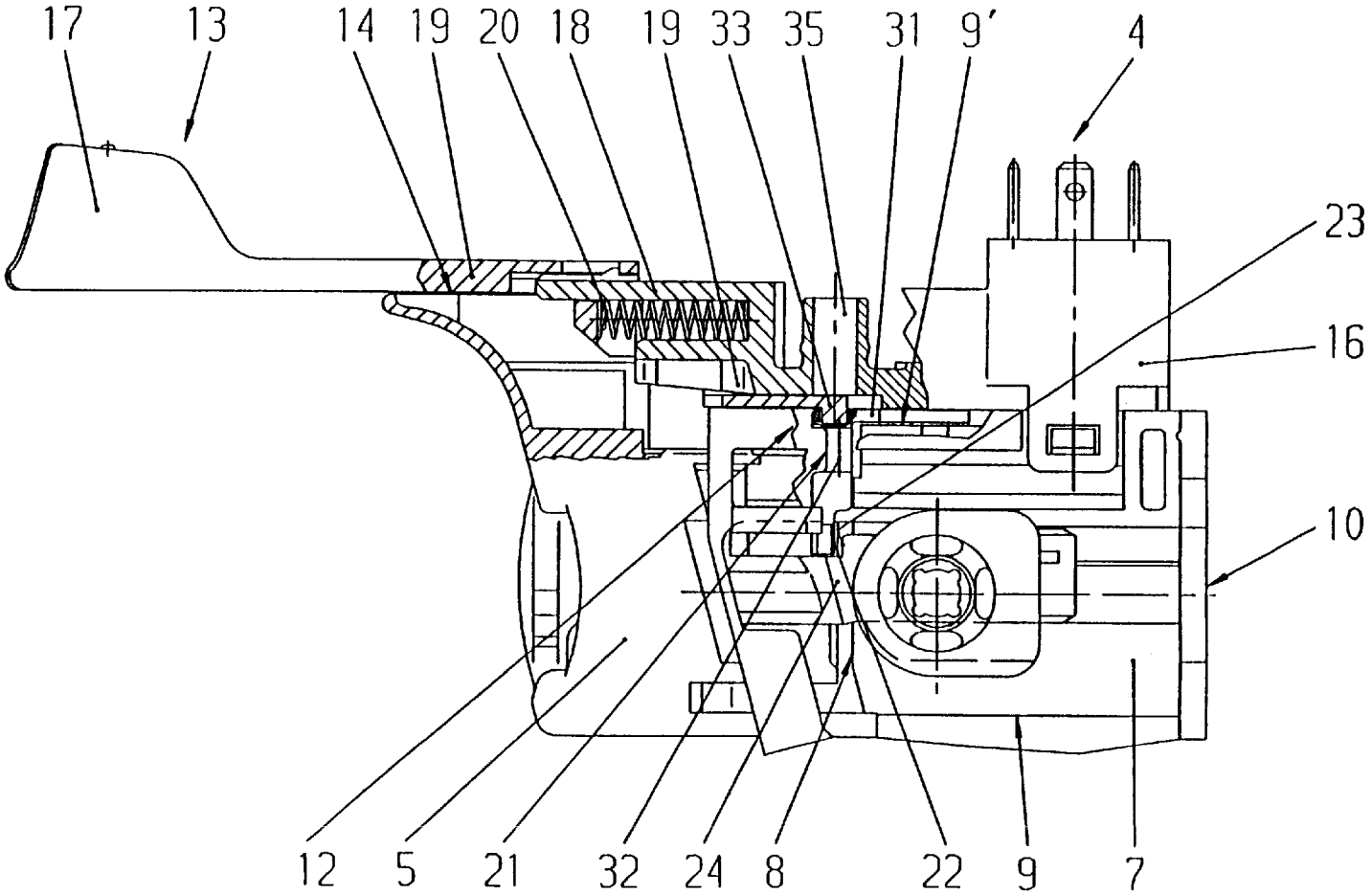
FIG. 4 shows part of an electrical switch with locking function in side view in a further embodiment, the area of the changeover switch being shown in partial section.
Figure 5:
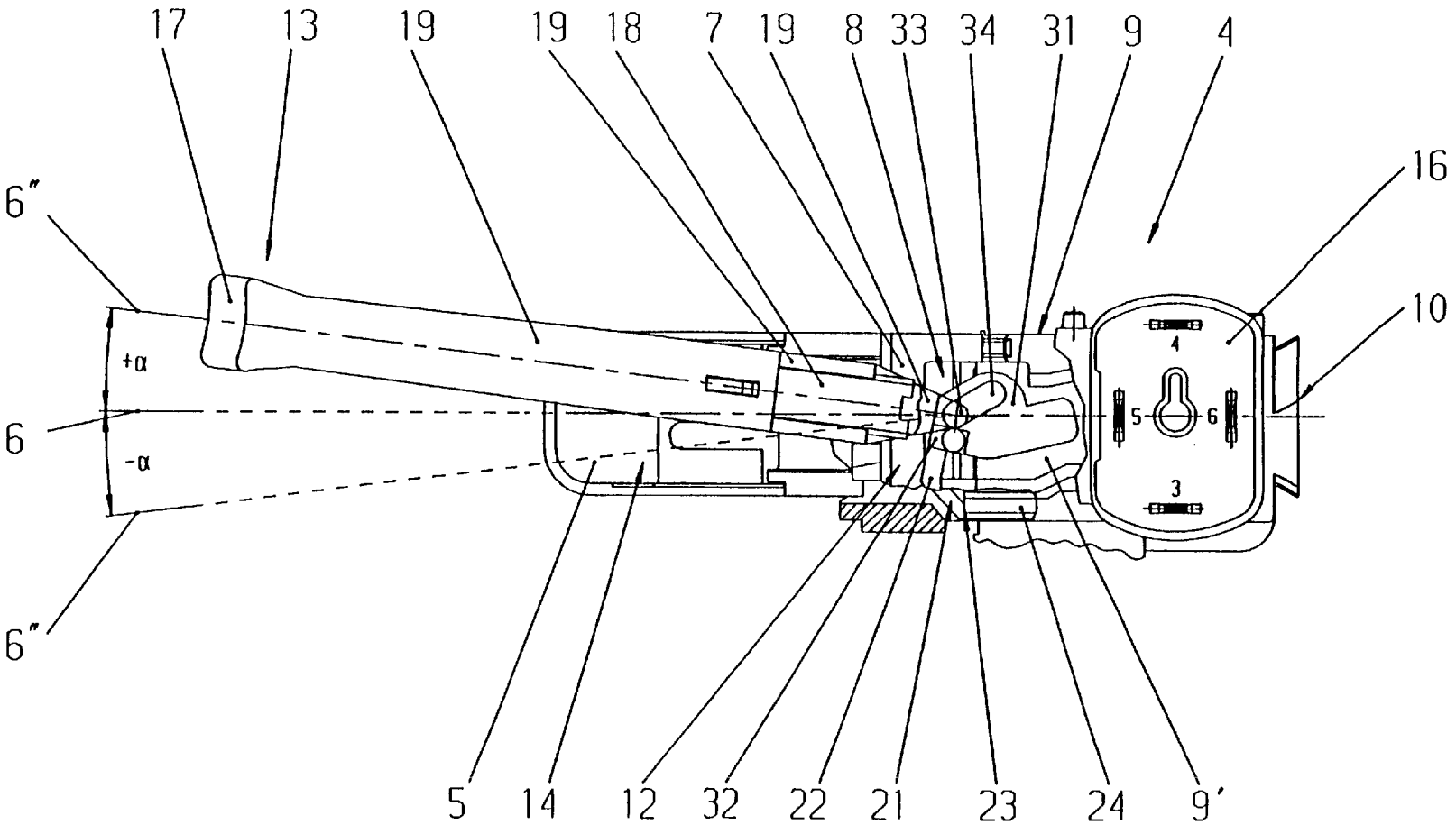
FIG. 5 shows the electrical switch from FIG. 4 in plan view, it being possible to see the changeover lever and the rest of the changeover switch being shown partially broken away.

The blocking element 21 corresponding to a further refinement is shown in FIGS. 4 and 5. Here, the blocking element 21 is designed as a lever element 31 that is mounted such that it can rotate on the housing 7 of the switch 4. The lever element 31 is mounted on the side wall 9' of the housing 7 which is assigned to the changeover switch 16 for the clockwise/counterclockwise rotation. From the lever element 31 there projects approximately perpendicularly an arm 32 which extends approximately parallel to the front wall 8 of the housing 7 facing the actuating member 5, and has a hook 22. A cam 33 on the actuating element 13, specifically on the linearly movable, second part 19 of the changeover lever 17, engages in a slotted guide 34 (which can be seen in FIG. 5) on the lever element 31 in such a way that the lever element 31 is pivoted during a linear movement of the actuating element 13. This pivoting movement is carried out in such a way that the hook 22, in order to lock, engages behind a face, specifically the blocking face 23 on the lateral slide 24, in the operating position of the actuating member 5. Of course, the hook 22 can also engage behind any other face on the actuating member 5.

As can be seen, it is therefore the case in both configurations that the locking of the actuating member 5 in the operating position is effected by the interaction of the hook 22 with the blocking face 23 on the actuating member 5 or on a part assigned to the actuating member 5 and the restoring force acting on the actuating member 5, which loads the actuating member 5 in the direction of movement 6' toward its initial position.

The switch 4 according to the invention is therefore distinguished by the fact that the actuating element 13 arranged in the immediate vicinity of the actuating member 5 acts to actuate a first device and, in addition, serves to actuate a further, second device. In order to actuate the first device, the actuating element 13 can be moved in a first direction. In order to actuate the second device, the actuating element 13 can additionally be moved in a second direction, the second direction being different from the first direction. According to the above exemplary embodiments, one of the two devices is a changeover switch 16 for the direction of rotation, that is to say for the clockwise/counterclockwise rotation of the electric motor 36, with which the changeover switch 16 can be changed over by means of the movable actuating element 13. Equally well, one of the two devices can also be a locking device 12 which, in order to lock the actuating member 5 in the operating position, can be brought into interaction with the actuating member 5. In this case, the actuating element 13 for actuating the locking device 12 can preferably be moved in a direction differing from the perpendicular to the direction of movement 6, 6' of the actuating member 5.

According to a further exemplary embodiment, which will be described in more detail below, one of the two devices is a device 37 for adjusting the carbon brushes for the electric motor 36 in accordance with its direction of rotation. As can be seen from FIG. 6, the device 37 for adjusting the carbon brushes is arranged on the electric motor 36, in order in this way to be able to adjust the carbon brushes with respect to the neutral zone for the purpose of optimization. Devices 37 of this type for adjusting the carbon brushes are disclosed by DE 195 45 651 A1, to which reference is made here.

Figure 9:
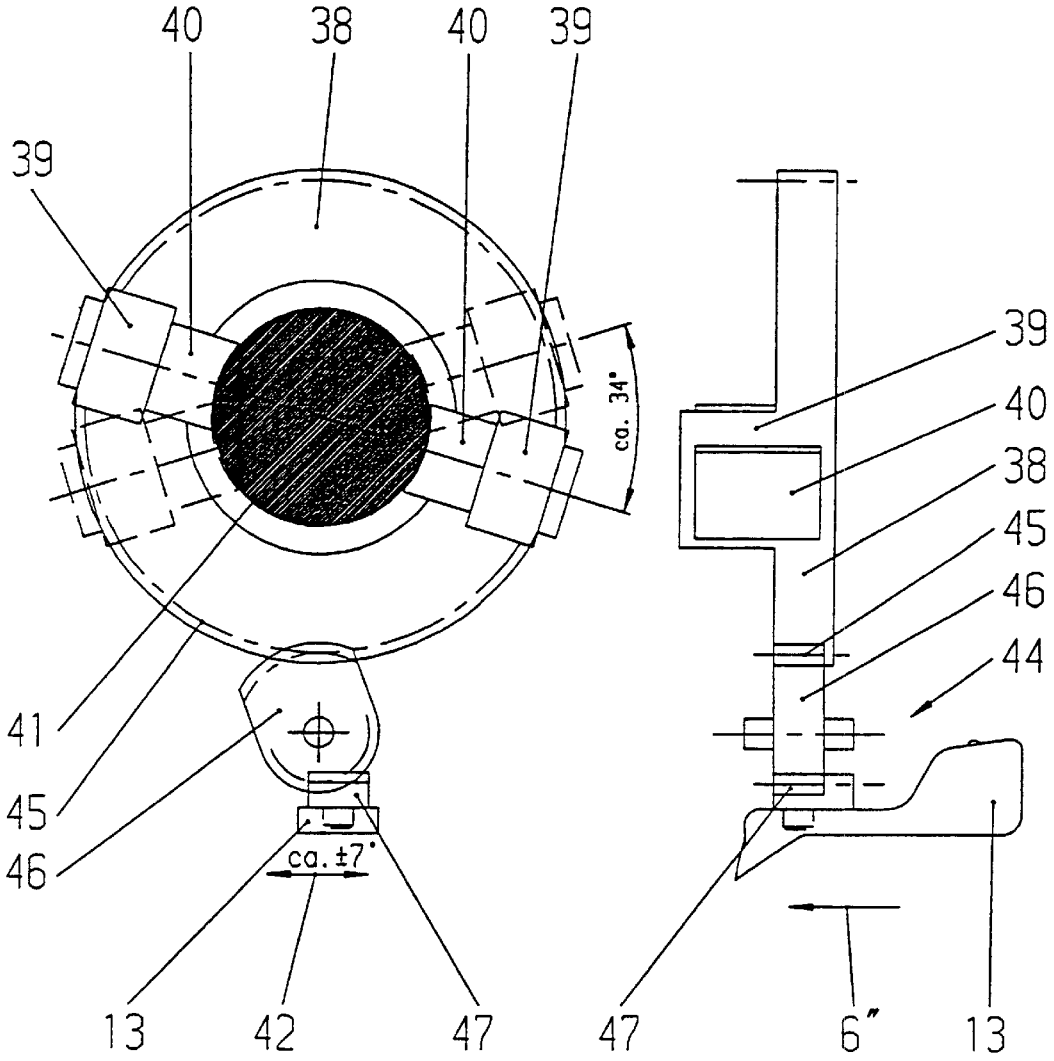
FIG. 9 shows the coupling element from FIG. 8 in schematic form, in plan view on the left and in side view on the right.

The device 37 for adjusting the carbon brushes has a pivotable carrier 38, on which brush holders 39, shown by way of example in FIG. 9, for the carbon brushes 40 which slip on the collector 41 of the electric motor 36 are arranged. In order to adjust the device 37, specifically in order to pivot the carrier 38 in accordance with the direction of rotation of the electric motor 36, use is made of the movable actuating element 13 which, according to the invention, is arranged in the immediate vicinity of the actuating member 5 of the switch 4.

Figure 6:
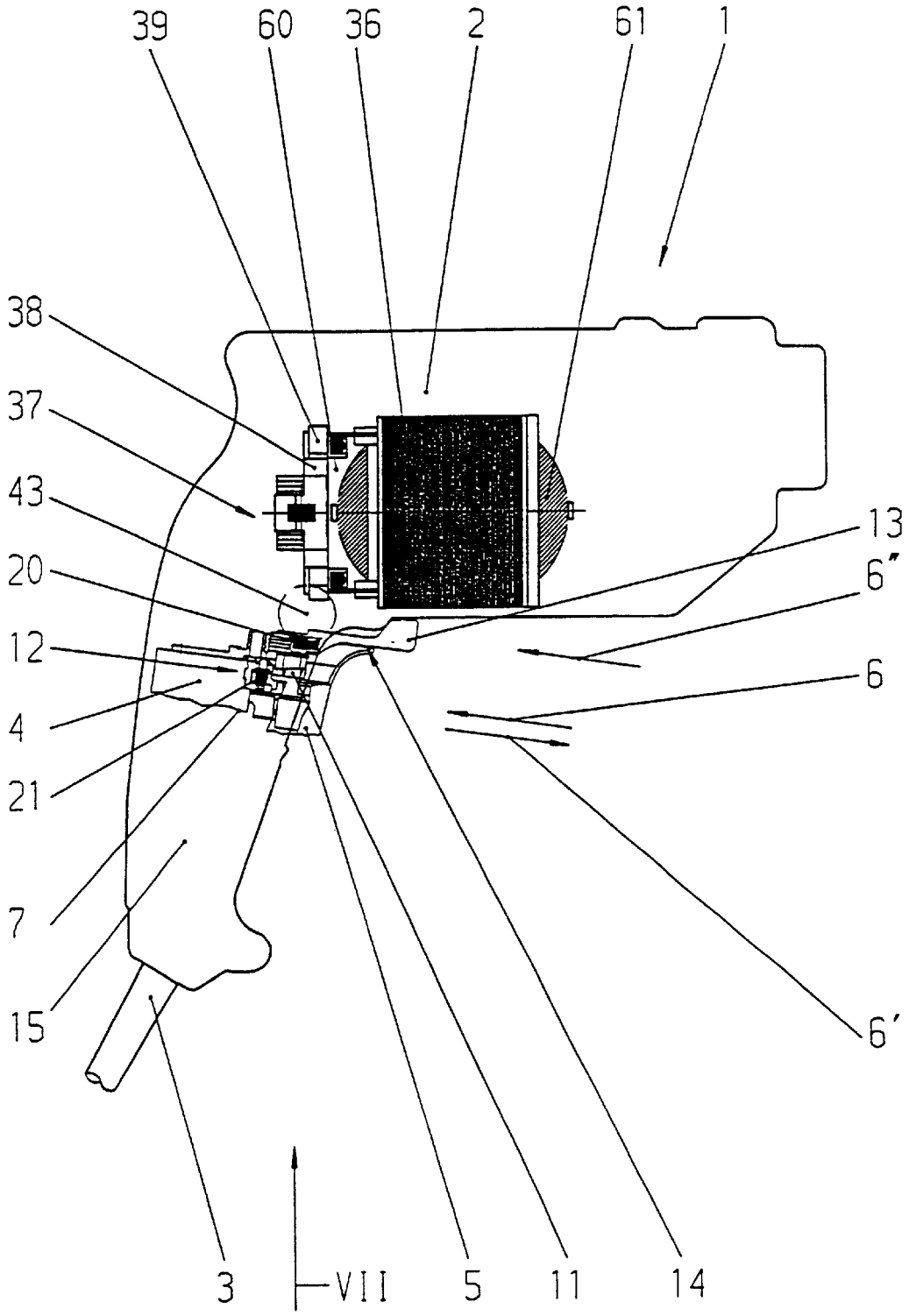
FIG. 6 shows, in schematic form, the housing body of an electric drill corresponding to a second embodiment.
Figure 7:
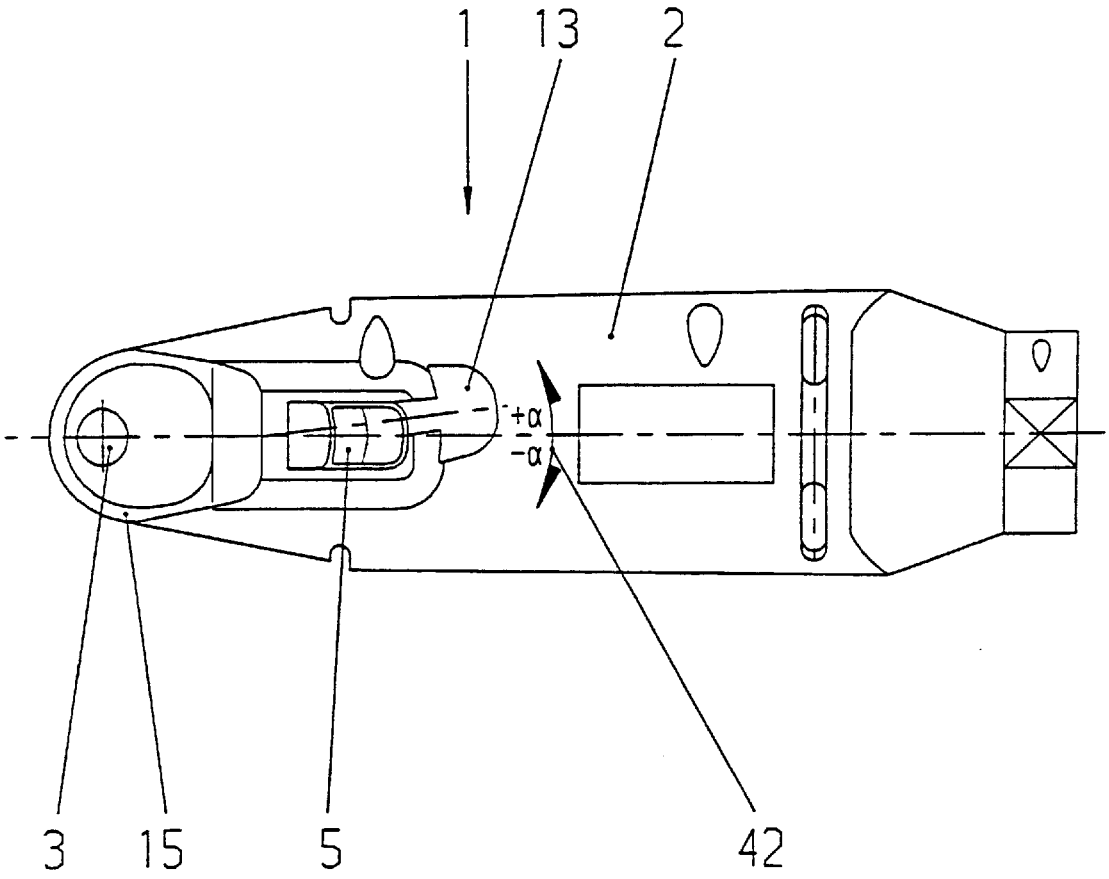
FIG. 7 shows a housing body as viewed in the direction VII of FIG. 6.

The actuating element 13 can be actuated by being pivoted in the pivoting direction 42 by a specific angle $+/-\alpha$, as emerges in more detail from FIG. 7. To this end, the actuating element 13 is designed as a lever, which is mounted such that it can rotate on the switch 4, to be specific on the housing 7 of the latter. In order to transmit the movement of the actuating element 13 to the carrier 38 to pivot the latter, a coupling element 43 shown only schematically in FIG. 6 is arranged between the actuating element 13 and the carrier 38. More detailed refinements of the coupling element 43 can be seen in FIGS. 8 to 13.

Figure 8:
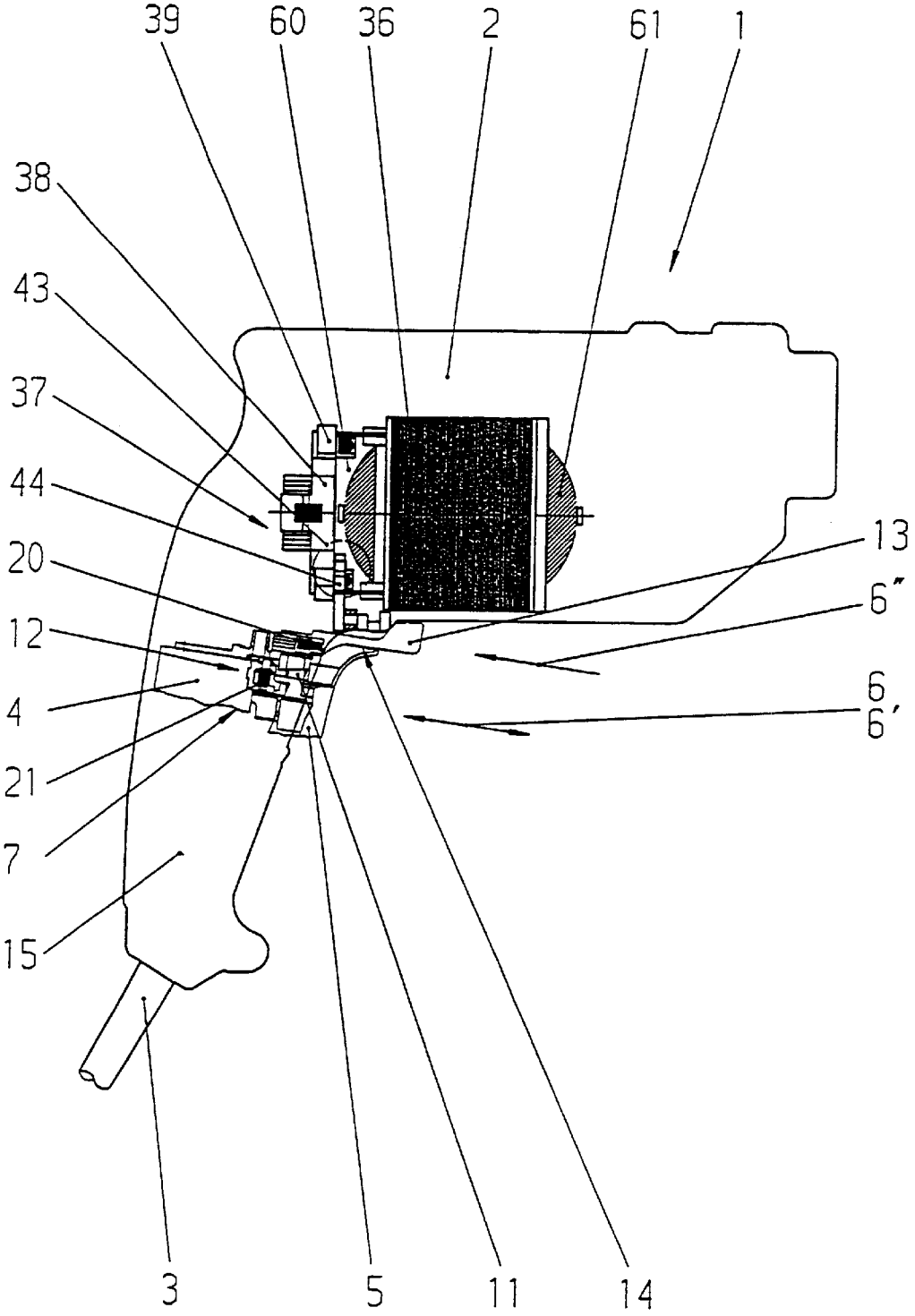
FIG. 8 shows the housing body as in FIG. 6, the coupling element being configured in a first embodiment in the manner of a gear mechanism.

The coupling element 43 shown in FIGS. 8 and 9 is designed in the manner of a gear mechanism 44. To this end, the carrier 38 is provided with toothing 45 on the circumference, as emerges in more detail from FIG. 9. A gearwheel, for example an asymmetrical spur gear 46, engages in the toothing 45. By means of a type of cam 47, the actuating element 13 in turn engages in the spur gear 46. The pivoting movement of the actuating element 13 is therefore transmitted to the carrier 38 via the gear mechanism 44 by means of an operative tooth-to-tooth connection or an operative cam-to-tooth connection. Of course, in order to transmit the pivoting movement, an operative cam-to-cam connection or the like can also be used.

Figure 10:
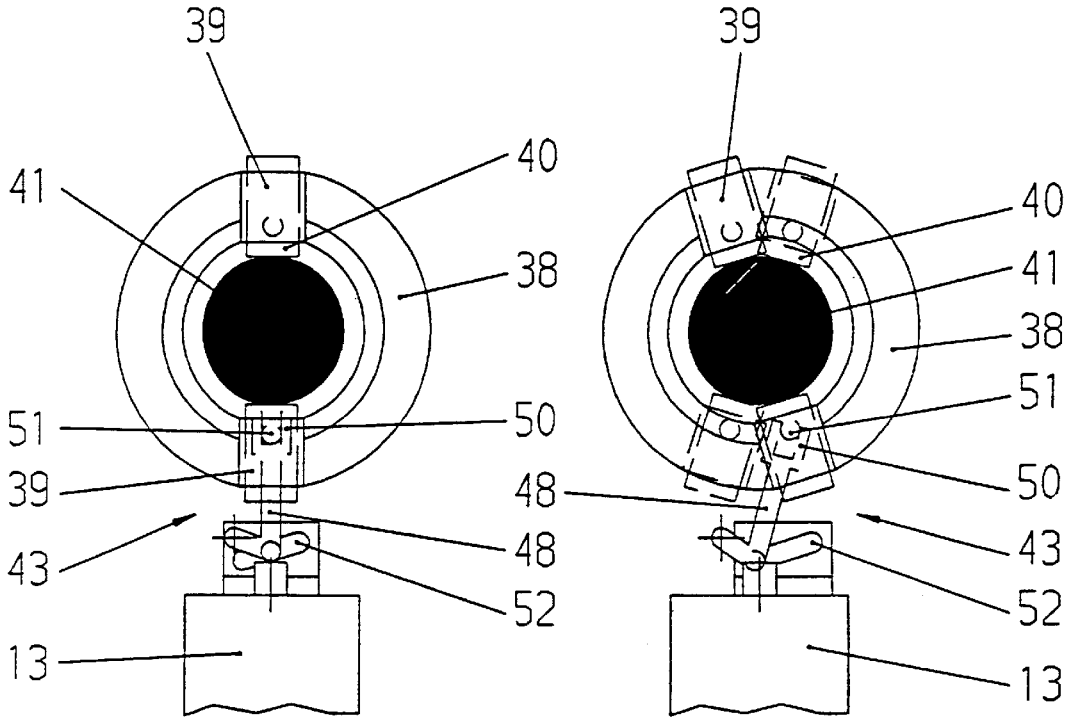
FIG. 10 shows the coupling element in a further configuration in the manner of a toggle lever, the central position of the actuating element being shown on the left and its pivoted positions being shown on the right.
Figure 11:
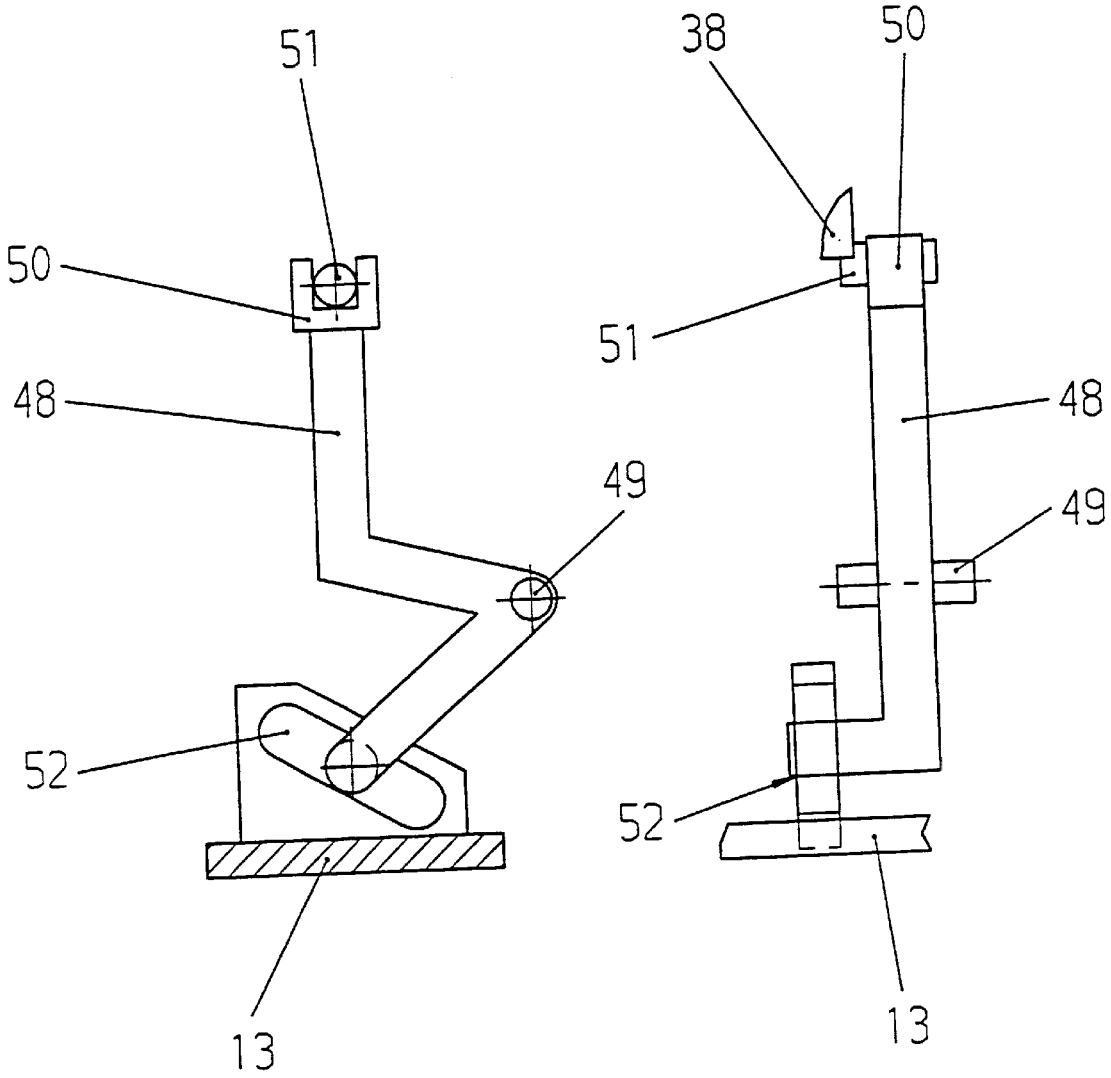
FIG. 11 shows the toggle lever from FIG. 10 as an individual part, the plan view being shown on the left and the side view being shown on the right.

In a further refinement, which can be seen in FIGS. 10 and 11, the coupling element 43 comprises a toggle lever 48. The toggle lever 48, which is mounted such that it can rotate on a rotary pin 49 in the housing body 2, at one end engages around a pin 51 on the carrier 38 by means of a type of fork 50. The other end of the toggle lever 48 is guided in a slotted guide 52, which is, for example, configured in the manner of an inclined plane. When the actuating element 13 is pivoted, the toggle lever 48 is guided appropriately in the slotted guide 52 and in the process is rotated about the rotary pin 49, so that ultimately the carrier 38 is pivoted by means of the operative connection between the fork 50 and pin 51.

Figure 12:
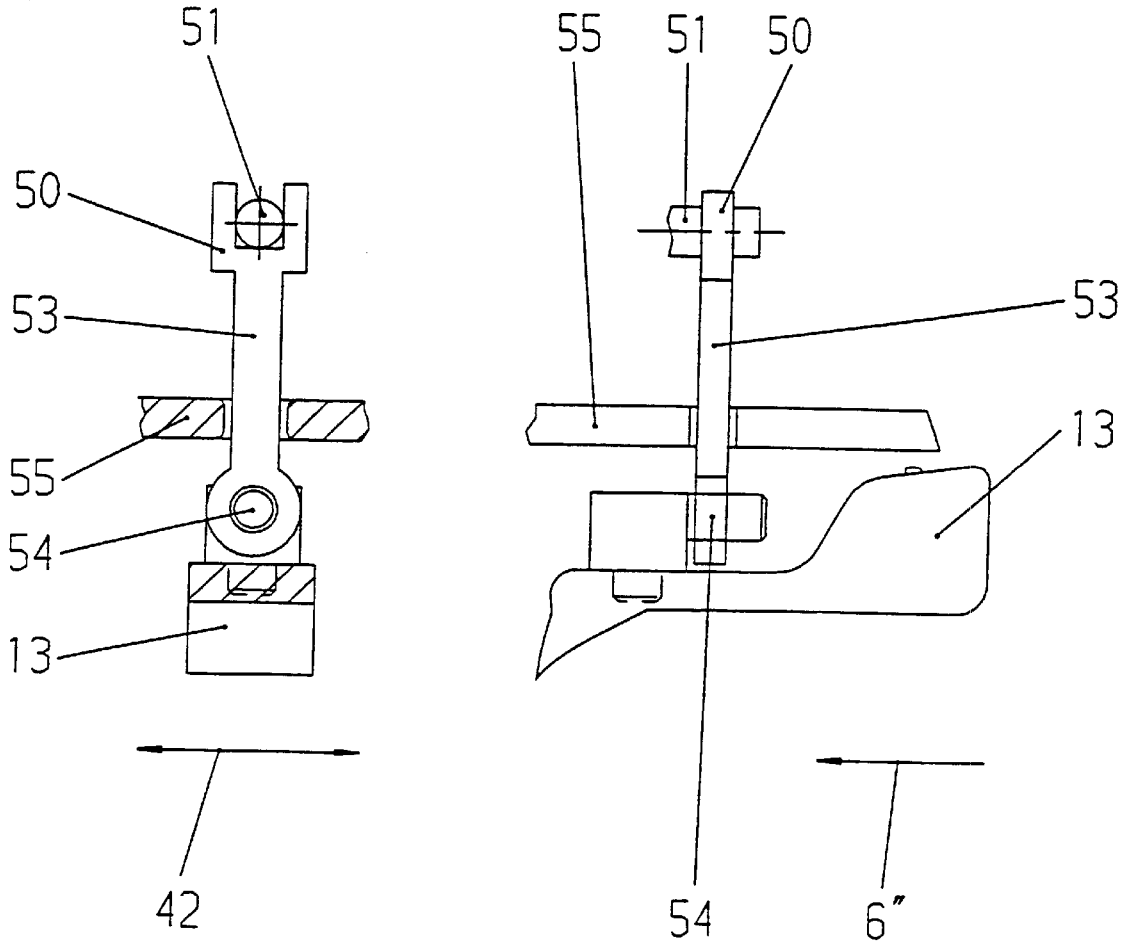
FIG. 12 shows the coupling element in a still further refinement in the manner of a tilting lever, the plan view being shown on the left and the side view being shown on the right.

In a still further refinement, shown in FIG. 12, the coupling element 43 comprises a tilting lever 53. One end of the tilting lever 53 again has an operative connection to the carrier 38, comprising a fork 50 and a pin 51. The other end of the tilting lever 53 is attached to the actuating element 13 by means of a rotary bearing 54. Pivoting the actuating element 13 in the pivoting direction 42 has the effect of rotating the tilting lever 53 about the rotary bearing 54, so that said lever is tilted about a stop 55 in the housing body 2, as a result of which, ultimately, again pivoting of the carrier 38 can be effected.

Figure 13:
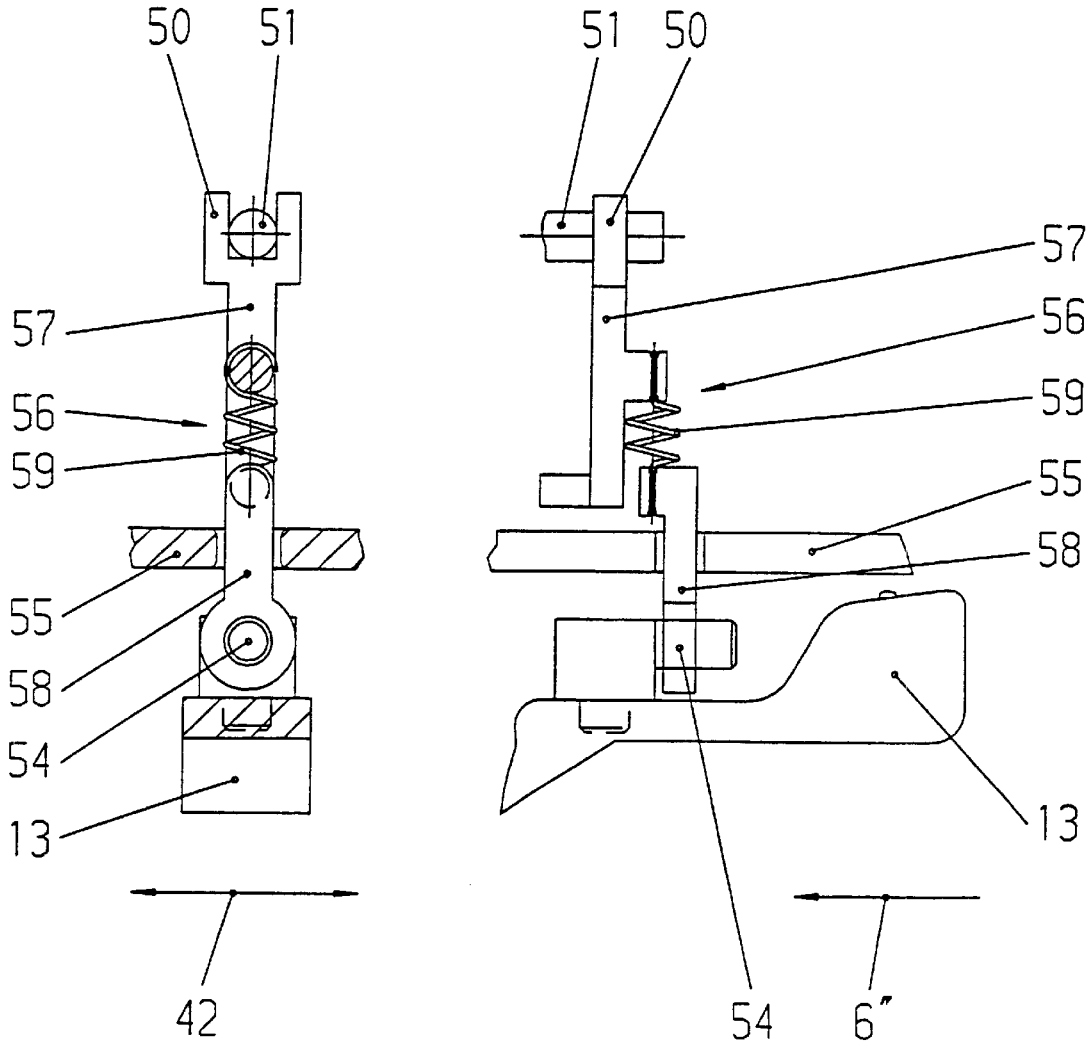
FIG. 13 shows the coupling element once again in a different embodiment in the manner of a tilting detent mechanism, it being possible to see the plan view on the left and the side view on the right.

The coupling element 43, which in a still further refinement forms a type of tilting detent mechanism 56, is illustrated in FIG. 13. The tilting detent mechanism 56 comprises two rotary levers 57, 58, one rotary lever 57 being attached to the carrier 38 by means of an operative connection comprising a fork 50 and a pin 51. The other rotary lever 58 is attached to the actuating element 13 by means of a rotary bearing 54. The two mutually facing ends of the rotary levers 57, 58 are coupled to each other by means of a tension spring 59. Pivoting the actuating element 13 in the pivoting direction 42 leads to the rotary lever 58 being tilted at the stop 55 in the housing body 2 and, because of the tension spring 59, leads to an abrupt rotary movement of the rotary lever 57 when a dead point is passed. The rotary movement of the rotary lever 57 then effects the pivoting of the carrier 38.

By means of the actuating element 13, it is advantageously possible for an electrical switch to be switched at the same time to reverse the direction of rotation of the electric motor 36. This switch for reversing the direction of rotation can be configured like the changeover switch 16 corresponding to the first exemplary embodiment, but it is expediently obvious to integrate the switch for reversing the direction of rotation into the device 37 for adjusting the carbon brushes.

In this case, for the switch for reversing the direction of rotation, switching contacts that are connected electrically to the carbon brushes 14 are arranged on the carrier 38. In addition, the device 37 for adjusting the carbon brushes has a stationary contact plate 60 (shown in FIG. 6) to accommodate fixed contacts, which are connected electrically to the field windings 61 of the electric motor 36. The fixed contacts interact with the switching contacts as mating contacts in order to make alternate contact with the carbon brushes 40 to reverse the direction of rotation of the electric motor 36 when the carrier 38 is pivoted. In order to obtain defined switching positions for the switch for reversing the direction of rotation, it is expedient if the switching positions that can be established by the interaction between the switching contacts and the fixed contacts as the carrier 38 is pivoted are designed as latching positions. Otherwise, for the more specific design of a switch of this type for reversing the direction of rotation, reference is again made to DE 195 45 651 A1.

Furthermore, it may be advantageous if here, too, by means of the actuating element 13, a locking device 12 for the operating position of the actuating member 5, said locking device 12 being shown in FIG. 6 and configured as in the first exemplary embodiment, can be actuated at the same time. The blocking element 21 of the locking device 12 which, in order to lock the actuating member 5 in the operating position, can be brought into interaction with the operating member 5, can be moved by a movement of the actuating element 13 in a direction differing from the direction of movement of the actuating element 13 in order to pivot the carrier 38. In particular, the actuating element 13 for the movement of the blocking elements 21 can be moved approximately according to the arrow 6" in the direction of the actuating member 5 by being pressed counter to the spring 20.

The invention has been explained in detail using an electric hand tool, but is not restricted to the exemplary embodiments described and illustrated. Instead, it also comprises all the developments which may be made by those skilled in the art within the scope of the idea of the invention. For example, a locking device according to the invention and/or a changeover switch according to the invention for the direction of rotation of the electric motor and/or a device according to the invention for adjusting the carbon brushes may be used not only on electric tools but also other electrical appliances, for example on handheld mixers, electric knives or the like for domestic use.

What is claimed is:

1. An electrical appliance comprising:

an electrical switch having an actuating member that can be moved between an initial position and an operating position in a direction of movement, wherein the actuating member, in the operating position, acts to switch a contact system or to adjust a potentiometer; and a movable actuating element arranged in an immediate vicinity of the actuating member, the actuating element, during movement, acting to actuate a first device and a second device, wherein the actuating element comprises:

a first part being mounted such that it can be moved in a second direction; and a second part that can be moved both with the first part in the second direction and also in a first direction that is different from the second direction such that the first device is actuated when the actuating element is moved in the first direction, and the second device is actuated when the actuating element is moved in the second direction.

2. The electrical appliance according to claim 1, wherein the actuating element can be moved within an angular range of less than +/−90 degrees and up to a maximum of +/−15 degrees in relation to the direction of movement of the actuating member such that the actuating element is moved approximately in the direction of the actuating member.

3. The electrical appliance according to claim 1 wherein the actuating element is arranged directly on an upper side of the actuating member at a transition location between a housing body and a handle of the electrical appliance, and the actuating element is a push button or a rotatably mounted lever, and wherein the actuating member is a trigger and is arranged on a housing of the switch such that the actuating element is pivotally moved by being pressed in the direction of movement of the trigger.

4. The electrical appliance according to claim 1 further comprising an electric motor that can be operated in two opposite directions of rotation, and wherein one of the first and second devices is a changeover switch for controlling the direction of rotation of the electric motor.

5. The electrical appliance according to claim 4 wherein one of the first and second devices is a locking device that interacts with the actuating member in order to lock the actuating member in the operating position, and in order to actuate the locking device, the actuating element is moved in a direction other than perpendicular to the direction of movement of the actuating member.

6. The electrical appliance according to claim 5 wherein the actuating element of the changeover switch is a two part changeover lever and is mounted such that the changeover lever can be pivoted, in particular by up to about +/−15 degrees, with respect to the direction of movement of the actuating member, and wherein the changeover lever for actuating the locking device can be moved in the longitudinal direction of the changeover lever, such that the first part of the actuating element can be pivoted, and the second part of the actuating element can both be pivoted with the first part and be moved linearly, counter to a restoring force, approximately radially with respect to the pivoting movement.

7. The electrical appliance according to claim 6, wherein the locking device has a blocking element that can be moved by means of the actuating element and is preferably mounted such that the blocking element can be moved on the housing of the switch, and is moved by the actuating element into engagement with a movement path of the actuating member in order to lock the actuating member.

8. The electrical appliance according to claim 7 wherein the blocking element further comprises:

a hook that, in order to lock, acts on a blocking face on the actuating member or on a slide connected to the actuating member guided laterally on the housing of the switch such that a return movement of the actuating member effected by a restoring force in the operating position is prevented.

9. The electrical appliance according to claim 8, wherein the blocking element is a spring-loaded slide element that is mounted such that the slide element can be moved linearly on a housing part of the switch;

wherein the housing part arranged at a transition location between walls of the changeover switch housing and the actuating member, such that the slide element is guided in the housing part approximately parallel to a front wall of the housing that faces the actuating member; and wherein the slide element includes the hook at a first end that faces away from a side wall of the housing such that a wedge face on the linearly movable, second part of the changeover lever, of the actuating element interacts with a second end of the slide element that faces the side wall of the housing such that the slide element is displaced by the movement of the actuating element such that, in order to lock, the hook acts on the blocking face on the actuating member in the operating position of the actuating member.

10. The electrical appliance according the claim 8, wherein the blocking element is designed as a lever element that is mounted such that the lever element can be rotated on a side wall of the housing of the switch, wherein an arm projects approximately perpendicularly from the lever element and extends approximately parallel to a front wall of the housing, and facing the actuating member, the arm including the hook wherein a cam on the linearly movable, second part of the changeover lever of the actuating element engages in a slotted guide on the lever element such that the lever element is pivoted by the movement of the actuating element such that the hook, in order to lock, engages behind the blocking face on a lateral side of the actuating member and in the operating position of the actuating member.

11. The electrical appliance according to claim 1 wherein one of the first and second devices is a device for adjusting carbon brushes of an electric motor in the direction of rotation of the electric motor.

12. The electrical appliance according to claim 11, wherein, the device for adjusting carbon brushes comprises a carrier that is pivoted by the actuating element and is arranged on the brush holders for the carbon brushes that slip on a collector of the electric motor.

13. The electrical appliance according to claim 12, wherein a coupling element is arranged between the actuating element and the carrier such that the movement of the actuating element can be transmitted to the carrier to pivot the carrier.

14. The electrical appliance according to claim 13, wherein the coupling element is a gear mechanism, having an asymmetrical spur gear, the gear mechanism having an operative tooth-to-tooth connection, an operative cam-to-tooth connection, or an operative can-to-cam connection.

15. The electrical appliance according to claim 13, wherein the coupling element comprises a toggle lever that can be moved by means of an inclined plane, a tilting lever, or a tilting detent mechanism.

16. The electrical appliance according to claim 11, wherein the device for adjusting the carbon brushes includes a changeover switch for changing the direction of rotation of the electric motor.

17. The electrical appliance according the claim 16 further comprising, switching contacts that are connected electrically to the carbon brushes and are arranged on the carrier, a stationary contact plate on the device for adjusting the carbon brushes to accommodate fixed contacts that are connected electrically to field windings of the electric motor;

wherein the fixed contacts interact with the switching contacts as mating contacts in order to make alternate contact with the carbon brushes to reverse the direction of rotation of the electric motor when the carrier is pivoted; and wherein the switching positions that can be established by the interaction between the switching contacts and the fixed contacts as the carrier is pivoted are designed as latching positions.

18. The electrical appliance according to claim 17, wherein the actuating element designed as a rotatable lever for pivoting the carrier of the device for adjusting the carbon brushes can be pivoted between the latching positions lying within an angular range ($+/-\alpha$), and wherein the lever for actuating the locking device can be moved approximately radially with respect to the pivoting movement by being pressed counter to a restoring force.

* * * * *